US005515148A

United States Patent [19]

Montfort

[11] Patent Number: 5,515,148

[45] Date of Patent: May 7, 1996

[54] RESONATOR ASSEMBLY INCLUDING A WAVEGUIDE MEMBER HAVING INACTIVE END SEGMENTS

[75] Inventor: David B. Montfort, Penfield, N.Y.

[73] Assignee: Xerox Corporation, Stamford, Conn.

[21] Appl. No.: 363,090

[22] Filed: Dec. 23, 1994

[51] Int. Cl.[6] ..... G03G 15/14

[52] U.S. Cl. ..... 355/273; 310/322

[58] Field of Search ..... 355/271, 273, 355/274; 228/1.1; 310/320–322, 325

[56] References Cited

U.S. PATENT DOCUMENTS

| | | | |
|---|---|---|---|
| 3,939,033 | 2/1976 | Grgach et al. | 228/1.1 X |
| 5,010,369 | 4/1991 | Nowak et al. | 355/273 |
| 5,025,291 | 6/1991 | Nowak et al. | 355/273 |
| 5,210,577 | 5/1993 | Nowak | 355/273 |

*Primary Examiner*—William J. Royer
*Attorney, Agent, or Firm*—Denis A. Robitaille

[57] ABSTRACT

An apparatus for enhancing toner release from an image bearing member moving in a process direction in an electrostatographic printing machine, including a resonator arranged in line contact with the back side of the image bearing member for applying vibratory energy to the image bearing member. The resonator includes a vibratory energy producing element such as a piezoelectric transducer for generating the vibratory energy and a waveguide member coupled to the vibratory energy producing element for directing the vibratory energy to the image bearing surface, wherein the waveguide member is divided into segments along a longitudinal axis thereof forming a plurality of waveguide segments with each waveguide segment being separated by a segmentation slot. The waveguide member of the present invention includes extended inactive end segments situated along opposite ends of the waveguide member and effectively decoupled from an active portion of the resonator for providing a stable mounting point for the resonator, which can be firmly attached to an external point in the electrostatographic printing machine without affecting the vibrational response of the active portion of the resonator such that substantially uniform vibratory energy can be generated across the length of the resonator. The resonator is preferably incorporated into a toner transfer system for enhancing transfer of toner from an image bearing member moving in a process direction, with the resonator positioned generally transverse to the process direction of movement of the image bearing member.

20 Claims, 4 Drawing Sheets

RESONATOR ASSEMBLY INCLUDING A WAVEGUIDE MEMBER HAVING INACTIVE END SEGMENTS

The present invention relates generally to an apparatus for applying vibratory energy to an imaging surface to enhance toner transfer in an electrostatographic printing machine and, more particularly, relates to an extended waveguide arrangement for a high frequency resonator useful in applying vibratory energy to an imaging surface in electrostatographic applications.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

Typically, the process of transferring charged toner particles from an image bearing support surface, such as a photoreceptor, to a second support surface, such as a copy sheet or an intermediate transfer belt, is enabled by overcoming adhesion forces holding toner particles to the image bearing surface. In a conventional electrostatographic printing machine, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. The corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Thus, the process of transferring development materials to a copy sheet in an electrostatographic printing system involves the physical detachment and transfer-over of charged toner particles from an image bearing surface to a second surface through the utilization of electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required in order to induce the physical detachment and transfer-over of the charged toner particles while maintaining the image configuration thereof without scattering or smearing of the developer material.

The use of vibratory energy has been disclosed, for example in U.S. Pat. No. 3,854,974 to Sato, et al., among other U.S. Patents, as a method for enhancing electrostatic toner release from an image bearing surface. More recently, systems incorporating a resonator, suitable for generating focused vibratory energy, arranged along the back side of the image bearing surface for applying uniform vibratory energy thereto, have been disclosed. In such systems, toner transfer is enhanced due to the mechanical release of the toner particles from the image bearing surface so that effective toner transfer can occur despite the fact that electrostatic charges in the transfer zone may be insufficient to attract toner from the image bearing surface to the second support surface. Exemplary systems of this nature are disclosed in U.S. Pat. Nos. 4,987,456 to Snelling et al.; 5,005,054 to Stokes et al.; 5,010,369 to Nowak et al.; 5,016,055 to Pietrowski et al.; 5,081,500 to Snelling et al.; and 5,210,577 to Nowak, among other U.S. Patents. The relevant teaching of the identified patents are incorporated by reference herein.

As disclosed in U.S. Pat. No. 4,987,456, a resonator suitable for generating focused vibratory energy generally includes a transducer element coupled to a resonating waveguide member having a contacting tip which is brought into tension or penetration contact with the image bearing belt for coupling the vibratory motion thereto. In systems which incorporate a resonator for applying uniform vibratory energy to the photoreceptor, it has been shown that it may be desirable to provide widthwise slots along the length of the resonator waveguide so as to segment the resonator into individually vibrating portions for providing increased velocity response across the waveguide, as well as improvements to process width velocity uniformity. Such segmentation is disclosed in the previously cited U.S. patents, among others, where the waveguide portion is cut perpendicularly to the plane of the image bearing surface, and generally parallel to the direction of travel of the image bearing surface to create an open-ended slot between each segment such that each segment acts more or less individually in response to the transducer.

It has been previously noted that there is a tendency for the response of the segmented waveguide segments to fall off along the edges of the resonator, corresponding to marginal regions of the photoconductive member, as a result of the continuous mechanical behavior of the resonator device. This phenomenon is commonly identified as the edge roll off effect. However, uniform response along the entire device, arranged across the entire width of the imaging surface of the photoconductive member, is required. Various solutions to this problem of edge roll off effect have been proposed in the prior art. The following disclosures may be relevant to various aspects of the present invention:

U.S. Pat. No. 5,010,369

Patentee: Nowak, et al.

Issued: Apr. 23, 1991

U.S. Pat. No. 5,025,291

Patentee: Nowak et al.

Issued: Jun. 18, 1991

U.S. Pat. No. 5,210,577

Patentee: Nowak

Issued: May 11, 1993

The relevant portions of the foregoing disclosures may be briefly summarized as follows:

U.S. Pat. No. 5,010,369 discloses a segmented resonator structure having a uniform response for electrophotographic imaging, wherein the resonator includes a waveguide horn, a continuous support member, and a continuous vibration producing member that drives the waveguide horn at a resonant frequency for applying vibratory energy to an image bearing belt surface. That patent discloses a waveguide horn which includes a platform or base portion, a horn portion extending therefrom, and a contacting tip, wherein the horn is segmented through the contacting tip to the platform portion for forming a plurality of waveguide horn segments which each act more or less individually. Alternative embodiments are also disclosed, wherein the vibration producing member that drives the horn, and/or the support member may also be segmented in a manner corresponding to each waveguide horn segment.

U.S. Pat. No. 5,025,291 discloses an edge roll off effect compensation scheme for high frequency vibratory energy producing devices used in electrophotographic imaging, wherein a resonator including a waveguide horn divided into a linear array of segments, and a corresponding array of vibration producing elements coupled to each horn segment, are each individually driven with a voltage to produce a high frequency vibratory response. The vibration producing elements coupled to the outer horn segments (along the marginal regions of the photoconductor) are driven with a higher voltage than those coupled to horn segments in the central portion of the array in order to avoid the problem of velocity response roll off which tends to occur at the outer segments of the array of waveguide horn segments.

U.S. Pat. No. 5,210,577 discloses another edge roll off effect compensation scheme for high frequency vibratory energy producing devices used in electrophotographic imaging, wherein a resonator including an energy transmitting waveguide horn having a platform portion and a horn portion further includes a set of linearly arranged horn elements, with each horn element having a contacting portion, a voltage source, and a plurality of vibratory energy producing devices, each corresponding to a waveguide horn element for driving the horn elements to vibrate such that each vibratory energy producing device produces a vibration responsive to an applied voltage signal directed to each from the voltage source. In that patent, the plurality of vibratory energy producing devices specifically includes at least two groups, each group having a vibration response to the applied voltage signal directed thereto distinct from the other, for providing a substantially uniform vibration response to the applied voltage signal across the length of the resonator.

The present invention is directed toward a resonator having an extended waveguide for uniformly applying vibratory energy to an image bearing surface in an electrophotographic device, wherein a relatively simple and effective means for eliminating the known phenomenon of edge roll off effect in high frequency vibratory energy producing devices is provided by effectively decoupling end elements of the waveguide horn extending beyond the marginal limits of the image bearing surface from the active vibration producing portion of the resonator aligned with the image bearing surface.

In accordance with one aspect of the present invention, there is provided a resonator assembly for applying uniform vibratory energy to an adjacent surface, comprising a vibratory energy producing element for generating vibratory energy, the vibratory energy producing element having a length corresponding to a dimension of the adjacent surface to which vibratory energy is to be applied, and a waveguide member coupled to the vibratory energy producing element for directing the vibratory energy from the vibratory energy producing element to the adjacent surface. The waveguide member includes an active section aligned with the length of the vibratory energy producing element, and inactive end segments situated along opposite ends of the active section and extending beyond the length of the vibratory energy producing element such that the inactive segments are not in alignment with the vibratory energy producing element, and, therefore are not in alignment with the adjacent surface to which vibratory energy is to be applied.

In accordance with another aspect of the present invention, a system for enhancing transfer of toner from an image bearing member moving in a process direction is provided, including a resonator assembly adapted to contact the image bearing member for applying uniform vibratory energy thereto. The resonator assembly comprises a vibratory energy producing element for generating the vibratory energy, wherein the vibratory energy producing element has a length corresponding to a dimension of the image bearing member to which vibratory energy is to be applied, and a waveguide member coupled to the vibratory energy producing element for directing the vibratory energy from the vibratory energy producing element to the image bearing member. The waveguide member further includes an active section aligned with the length of the vibratory energy producing element, and inactive end segments situated along opposite ends of the active section and extending beyond the length of the vibratory energy producing element such that the inactive segments are not aligned with the vibratory energy producing element.

In accordance with yet another aspect of the present invention, an electrostatographic printing apparatus having a system for enhancing transfer of toner from an image bearing member moving in a process direction is provided, wherein a resonator assembly is adapted to contact the image bearing member, generally transverse to the process direction of movement thereof, for applying uniform vibratory energy thereto. The resonator assembly comprises a vibratory energy producing element for generating the vibratory energy, wherein the vibratory energy producing element has a length corresponding to a dimension of the image bearing member to which vibratory energy is to be applied, and a waveguide member coupled to the vibratory energy producing element for directing the vibratory energy from the vibratory energy producing element to the image bearing member. The waveguide member further includes an active section aligned with the length of the vibratory energy producing element, and inactive end segments situated along opposite ends of the active section and extending beyond the length of the vibratory energy producing element such that the inactive segments are not aligned with the vibratory energy producing element.

These and other aspects of the present invention will become apparent from the following description in conjunction with the accompanying drawings, in which.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

Figure 5:
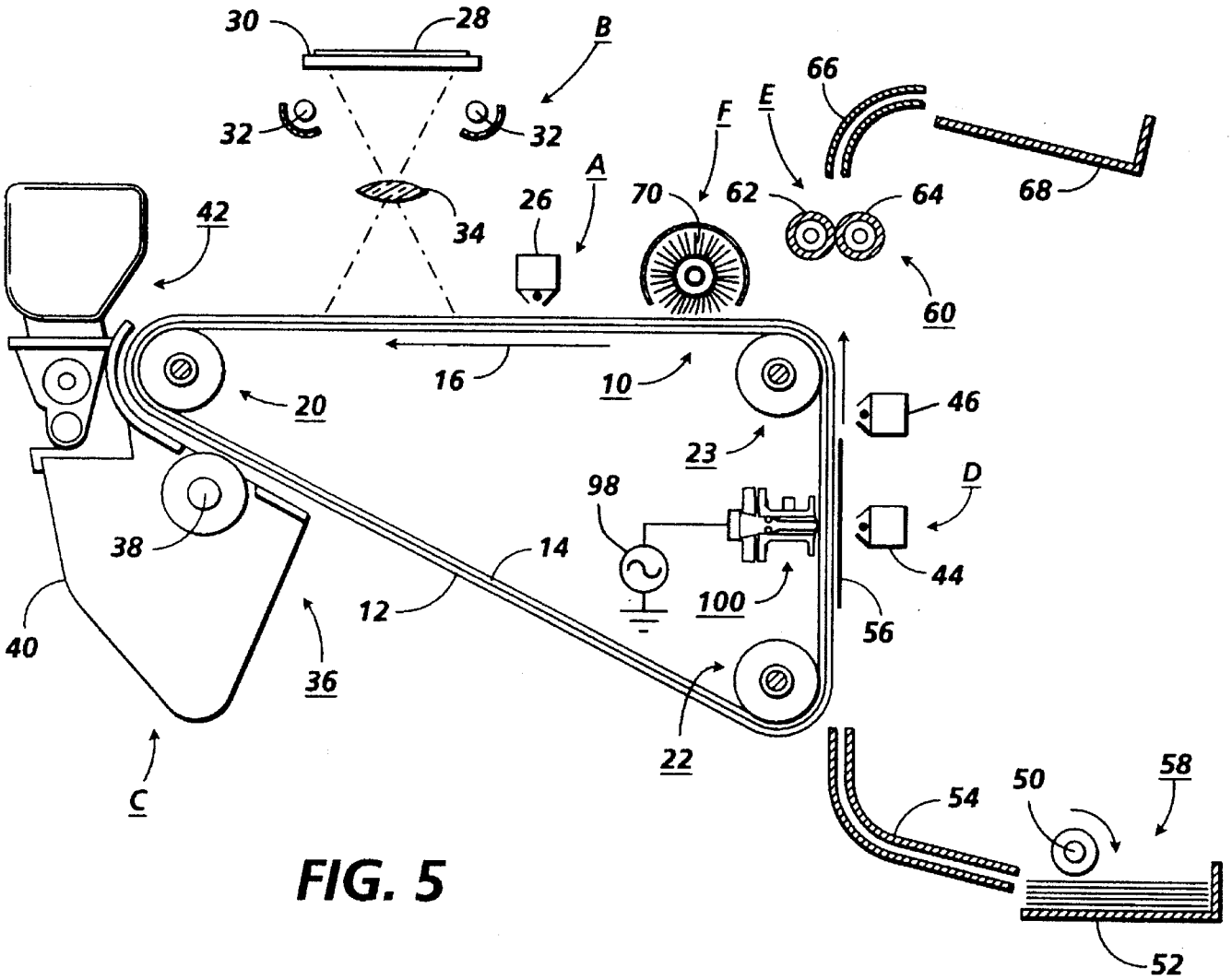
FIG. 5 is a schematic side view of an illustrative electrophotographic reproducing machine including an exemplary transfer station incorporating the resonator of the present invention.

For a general understanding of an exemplary printing machine incorporating the features of the present invention, a schematic depiction of the various processing stations, and the machine components thereof, is provided in FIG. 5. Although the resonator arrangement of the present invention is particularly well adapted for use with a transfer subsystem in an automatic electrophotographic reproducing machine as shown in FIG. 5, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example. It will be further appreciated that the present invention is not necessarily limited to the particular embodiment or embodiments shown and described herein.

Thus, prior to discussing the features and aspects of the present invention in detail, a schematic depiction of an exemplary electrophotographic reproducing machine incorporating various subsystems is furnished in FIG. 5, wherein an electrophotographic reproducing apparatus employs a belt 10, including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in a process direction of travel indicated by arrow 16. The process direction 16 is a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a developer roll 38 disposed in a developer housing 40. Toner particles are mixed with carrier beads in the developer housing 40, generating an electrostatic charge which causes the toner particles to cling to the carrier beads, thereby forming the developing material. The magnetic developer roll 38 is rotated in the developer housing 40 for attract the developing material to form a "brush" comprising the developer roll 38 with carrier beads with toner particles magnetically attached thereto. As the developer roll 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy sheet or substrate, is moved into contact with the developed toner image on belt 10 via sheet feeding apparatus 58 and chute 54 for synchronously placing the sheet 56 into contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the support material 56 while the support material 56 is also electrostatically tacked to photoreceptor belt 10.

With particular reference to the principle of enhanced toner release as provided by a vibratory energy assisted transfer system, the exemplary transfer station D of FIG. 5 includes a vibratory energy producing device or resonator 100 which may include a relatively high frequency acoustic or ultrasonic transducer driven by an AC voltage source 98. The resonator 100 is arranged in vibratory relationship with the back side of belt 10 at a position corresponding to the location of corona generating device 44 for applying vibratory energy to the belt 10 and for agitating the toner developed in imagewise configuration thereon to provide mechanical release of the toner particles from the surface of the belt 10. The vibratory energy enhances toner transfer by dissipating the attractive forces between the toner particles and the belt 10. In a preferred arrangement, the resonator 100 is configured such that the vibrating surface thereof is parallel to photoreceptor belt 10 and transverse to the direction of belt movement 16. The belt 10 has the characteristic of being nonrigid, or somewhat flexible, to the extent that it can be effected by the vibrating motion of the resonator 100, thereby providing mechanical release of the toner from the surface of belt 10 and allowing more efficient electrostatic attraction of the toner to a copy sheet during the transfer step.

Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems have been previously cited herein, which are incorporated in their entirety by reference into the present application for patent. Further details of vibratory assisted toner release in electrostatographic applications can also be found in an article entitled "Acoustically Assisted Xerographic Toner Transfer", by Crowley, et al., published by The Society for Imaging Science and Technology (IS&T) Final Program and Proceedings, 8th International Congress on Advances in Non-Impact Printing Technologies, Oct. 25–30, 1992. The contents of that paper are also incorporated by reference herein.

Continuing with a description of the exemplary electrophotographic printing process, after the transfer step is completed, a corona generator 46 charges the support material 56 with an opposite polarity to release the support material from belt 10, whereupon the support material 56 is stripped from belt 10. The support material 56 is subsequently separated from the belt 10 and transported to a fusing station E. It will be understood by those of skill in the art, that the support material may also be an intermediate surface or member, which carries the toner image to a subsequent transfer station for transfer to a final support surface. These types of surfaces are also charge retentive in nature. Further, while belt type members are described herein, it will be recognized that other substantially nonrigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support material 56 therebetween. The toner image is thereby forced into contact with the support material 56 between fuser rolls 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor belt, paper delivery, xerographic processing functions associated with developing and transferring the developed image onto the paper, and various functions associated with support material transport and subsequent finishing processes. As such, the controller initiates a sequencing schedule which is highly efficient in monitoring the status of a series of successive print jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown) coupled to the controller.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 1:
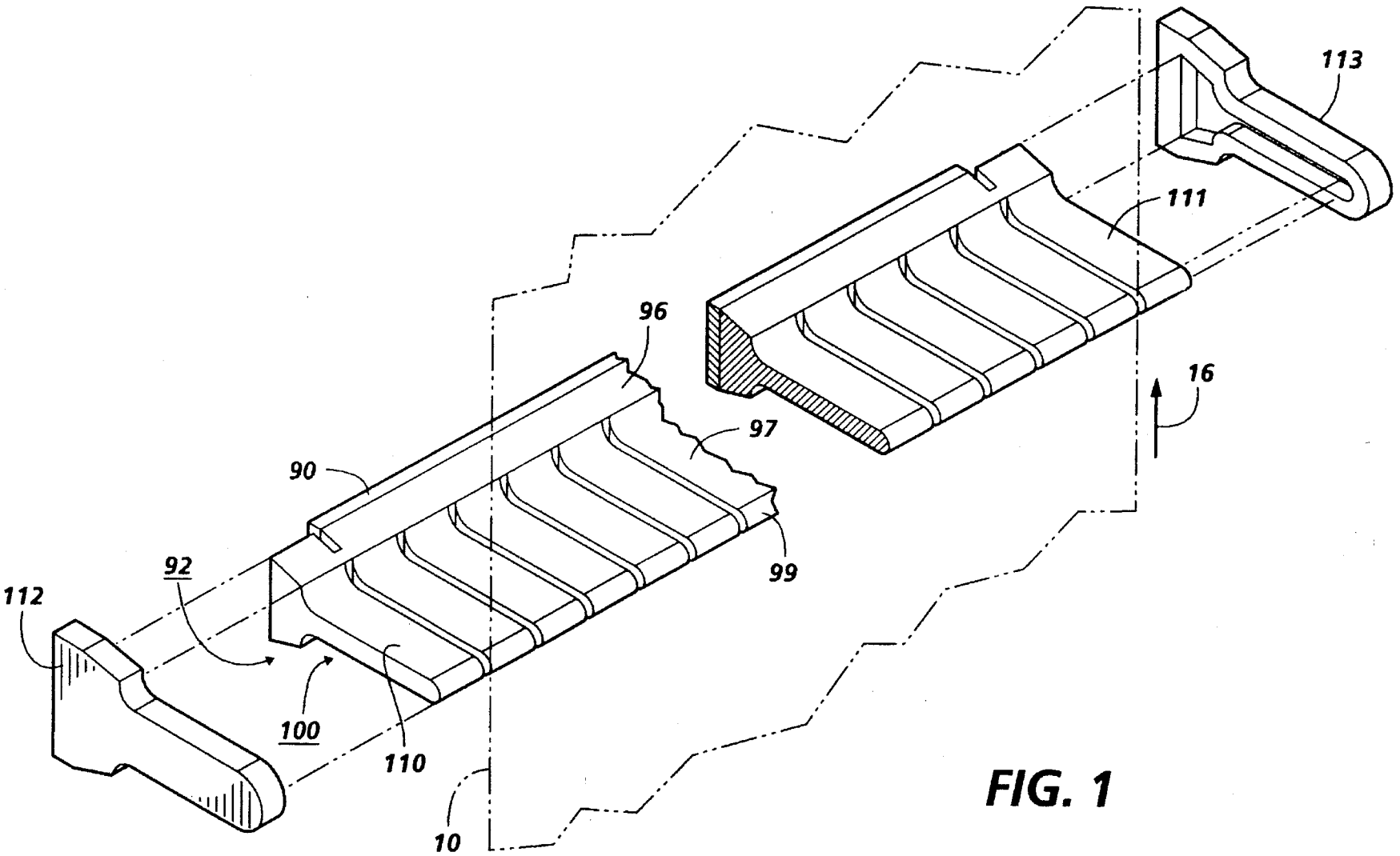
FIG. 1 is a partially broken away, perspective view of a resonator situated adjacent an image bearing photoconductive member, wherein the resonator includes an extended length waveguide having inactive end segments in accordance with the present invention.

With particular reference to FIG. 1, and as previously discussed, the principle of enhanced toner release as provided by the vibratory energy assisted transfer system described hereinabove is facilitated by a relatively high frequency acoustic or ultrasonic resonator 100 which is preferably situated substantially in contact with the back side of belt 10, at a position in substantial alignment with the corona generating device 44. In a preferred arrangement, the resonator 100 is arranged with a vibrating surface parallel to belt 10 and transverse to the process direction of movement of the belt 10, generally indicated by arrow 16. The resonator 100, includes a vibratory energy producing element 90, and as a piezoelectric transducer (driven by an A.C. voltage source), generally operated at a frequency between 20 kHz and 200 kHz and typically at approximately 60 kHz. A waveguide member 92 is coupled to the piezoelectric transducer 90 for transmitting the vibratory energy generated thereby to the belt 10. An adhesive epoxy and conductive mesh layer or other materials, as discussed, for example, in U.S. patent application Ser. No. 08/332,152, of common assignee, may be used to bond the transducer and waveguide elements together without the requirement of additional mechanical coupling devices. The waveguide member 92 is preferably fabricated from aluminum, having a platform portion 96, a horn portion 97 and a contacting tip 99 for contacting belt 10 to impart the vibratory energy of the transducer 90 thereto. Various shapes and structures have been considered for the waveguide member 92, as discussed in U.S. Pat. No. 4,987,456; while a "stepped horn" waveguide is shown, it will be understood that other shapes, such as an exponential shape, a conical shape, or the like may also be employed. In addition, in accordance with known resonators utilized in the electrostatographic printing arts, the horn portion of waveguide member 92 is cut perpendicularly to the plane of the photoconductive surface, and generally parallel to the process direction of travel thereof, while a continuous piezoelectric transducer 90 is maintained. This arrangement produces an array of waveguide horn segments along a longitudinal axis of the resonator and provides a frequency or velocity response along the length of the contacting tip which tends toward uniformity. It is also noted that the velocity response across the segmented horn tip configuration is greater than that of an unsegmented horn tip, a desirable result.

Figure 2:
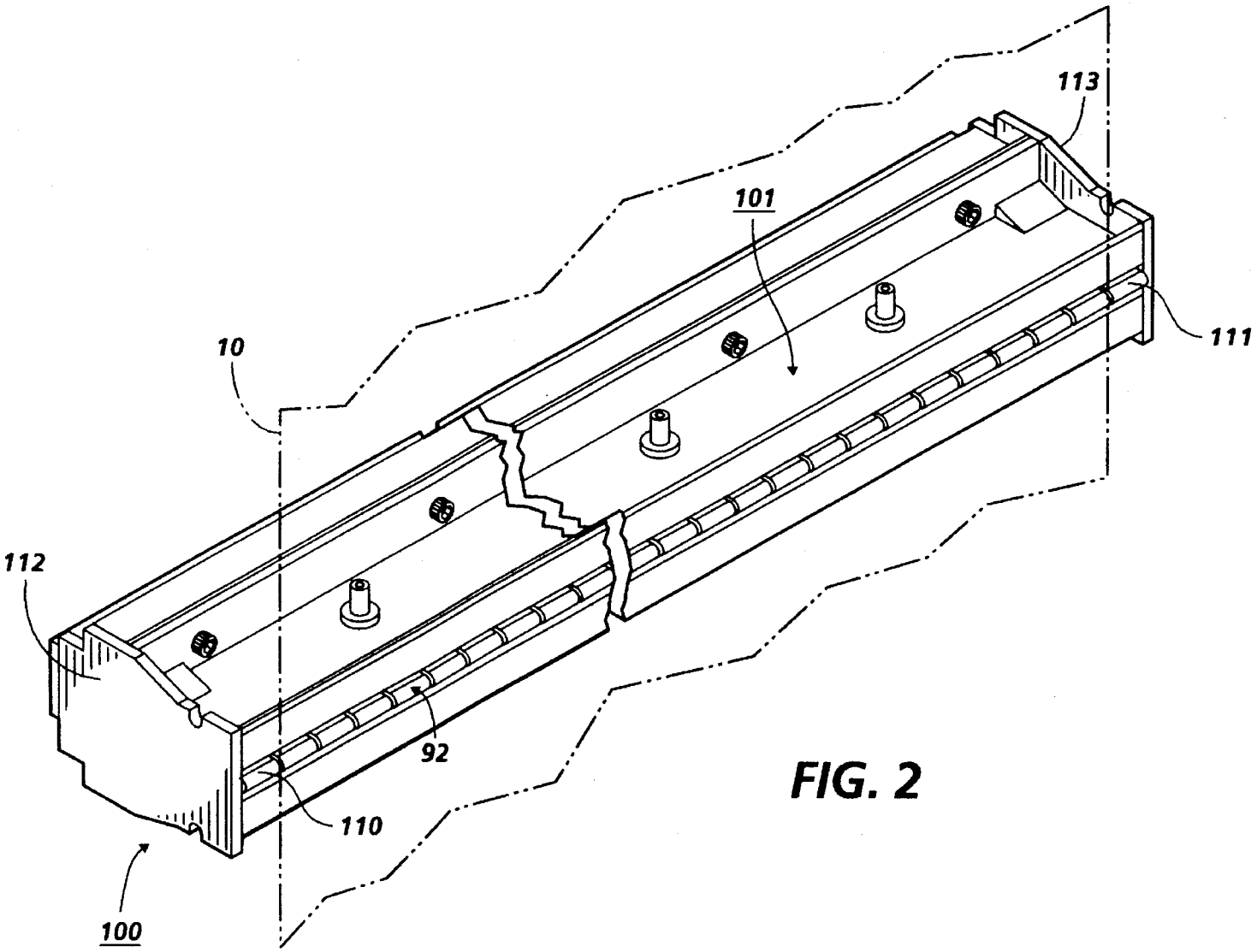
FIG. 2 is a partially broken away, perspective view of a resonator including a vacuum plenum, wherein the resonator includes an extended length waveguide horn having inactive end segments in accordance with the present invention.

It will be understood that, in order to provide a coupling arrangement for transmitting vibratory energy from the resonator 100 to the photoreceptor belt 10, the resonator may be arranged in association with a vacuum arrangement, as disclosed in the prior art and as shown generally in FIG. 2. In this arrangement, for example, the resonator 100 may be configured in association with a so-called vacuum plenum 101 which may be of a type disclosed in U.S. Pat. No. 5,357,324 (incorporated by reference herein). The vacuum plenum arrangement is advantageously utilized to urge belt 10 into positive contact with the resonator 100 so that the waveguide member 92 can effectively impart vibratory energy to belt 10. A coupling cover (not shown) may also be provided at the interface between the waveguide member and the photoreceptor belt to create a replaceable protective coupling attachment for extending the functional life of the resonator 100, and, in particular, the waveguide member portion thereof, as well as that of the photoreceptor belt 10. A resonator coupling cover advantageously protects the resonator 100 from wear and minimizes the effect of a torque spike occurring from contact with a seam in the photoreceptor belt 10 while enhancing toner release provided by the vibratory energy assisted transfer system by creating a damping effect for eliminating image quality defects caused by dissemination of vibrational energy outside the region of transfer. The particular features of the resonator coupling-cover and horn waveguide member, as well as various embodiments therefor, are discussed in detail in the various U.S. patents referenced herein.

As previously discussed, it is highly desirable for the waveguide member 92 to produce a uniform response along its length for transmitting uniform vibratory energy to the photoconductive surface to prevent image defects caused by nonuniform transfer characteristics. It is also highly desirable to provide the resonator in the form of a unitary structure for efficient manufacturing and effective application requirements.

Thus, as previously discussed, systems incorporating a resonator for applying uniform vibratory energy to the photoreceptor belt typically incorporate segmentation of the waveguide member so as to divide the waveguide member into individually vibrating portions. Such segmentation is typically accomplished by providing a series of segmentation slots along the length, or the longitudinal axis, of the waveguide member 92. Thus, the waveguide member 92 is cut perpendicularly to the plane of the photoconductive surface, generally parallel to the process direction of travel of the photoconductive surface, and perpendicular to the longitudinal axis of the resonator. Each segmentation slot extends generally through the contacting tip 99 and the horn portion 97 of the the waveguide member 92, while the platform portion 96 remains continuous and in tact adjacent to the transducer 90. With the waveguide member 92 fully segmented, each waveguide member segment tends to act more or less as an individual resonating element with each segment responding individually to the transducer 90. Alternatively, a fully segmented resonator may be provided with a segmented transducer 90 in conjunction with a partially segmented waveguide member, cut through the contacting tip and through the horn portion extending to a platform portion, with the platform portion remaining continuous in the area adjacent to the segmented transducer. This alternative embodiment allows for individually applying voltage across each transducer segment in order to tailor frequency response across the length of the resonator such that nonuniform frequency response may be compensated by causing the transducer of the resonator to be segmented into a series of individual resonator devices with each transducer segment having a separate driving signal.

While segmentation of the resonator as described hereinabove, and as shown in the art, generally provides beneficial results with respect to uniformity of frequency response across the length of the resonator, it is noted that some negative side effects may also result, particularly in electrostatographic applications. Specifically, it has been noted that there is a tendency for the response of the segmented waveguide member horn segments to fall off along the extreme marginal edges of the waveguide member horn as a result of the continuous mechanical behavior of the device, a phenomenon known as edge roll off, as previously discussed. The edge roll off phenomenon is unacceptable since uniform response along the entire device, arranged across the width of the photoconductive surface is required. The edge roll off effect described hereinabove results in incomplete image transfer along the marginal inboard and outboard edges of the photoconductive surface.

In the work leading to the present invention, it was determined that the edge roll off effect is generated, most significantly, by the mounting apparatus typically utilized for supporting the resonator in a fixed position adjacent the photoreceptor belt belt in the electrostatographic printing machine. Typically, the resonator is mounted within the machine by means of a side mounting arrangement attached to the end segments of the resonator for securing the resonator into position relative to the photoreceptor belt belt within the electrostatographic machine. This side mounting arrangement tends to absorb the vibrational energy transmitted through the end segment, resulting in the aforementioned edge roll off effect.

Figure 3:
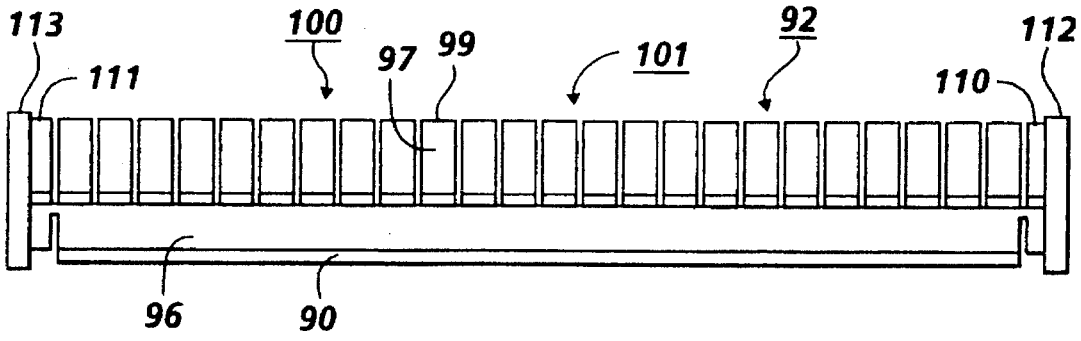
FIG. 3 is a schematic plan view of a resonator having an extended length waveguide, showing the side mount arrangement of the present invention.
Figure 4:
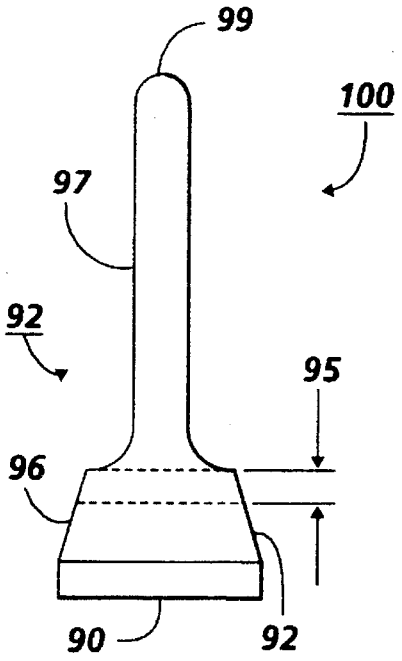
FIG. 4 is a cross sectional end view of an inactive end segment of the extended length waveguide of the present invention.

The present invention is directed toward the problems associated with edge roll off in a resonator of the type described, and is specifically directed toward eliminating the edge roll effect by providing an extended, inactive waveguide member segment at opposite ends of the waveguide member assembly for permitting a side mounting arrangement which does not absorb vibrational energy transmitted through the waveguide member member. Referring to FIGS. 1–3, the resonator 100 of the present invention includes an extended length segmented waveguide member 92 having "dead" or inactive end segments 110 and 111 located at opposite ends of the waveguide member member 92. The inactive end segments 110 and 111 extend beyond the length of the transducer 90 and, therefore, are not aligned with a corresponding portion of the transducer 90. Thus, as can be seen in FIGS. 1 and 3, the waveguide member can be characterized as having an active section along a central portion thereof aligned with transducer 90, and inactive sections 110 and 111 along opposite ends of the active section, wherein the inactive segments are not aligned with the transducer 90. The transducer element 90 has a length corresponding only to the length of the active section of the waveguide member. It follows that the length of the transducer also corresponds to the process width of the photoconductive surface. Inactive end segments 110 and 111 are further functionally detached from the active section of the waveguide member 92 by means of a decoupling slot between the active section and each inactive end segment, the decoupling slot extending through the platform portion 96 to a so-called nodal plane 95, illustrated in FIG. 4, wherein the nodal plane 95 defines an area in the waveguide member at which no vibration takes place such that the wave field travelling through the waveguide member 92 is essentially zero amplitude. It will be understood that the decoupling slot is aligned with and operates in conjunction with a typical segmentation slot extending through the contacting tip 99 and the horn portion 97 to the nodal plane 95 so as to effectively decouple each end portion 110 and 111 from the active, vibratory producing portion of the waveguide member.

The active section of the waveguide member 92 is aligned with the photoconductor belt 10 for transmitting vibratory energy thereto, while the inactive sections 110 and 111, being delineated by decoupling slots, are situated outside the marginal regions of the photoconductor belt 10 so as to have no effect thereon. It is noted that previously cited U.S. Pat. No. 5,010,369 suggests that an extended resonator structure might be provided, wherein, by extending the resonator beyond the length of the photoreceptor belt, the most uniform response region of the resonator can be maintained in alignment with the photoreceptor belt. However, the teaching of that patent does not teach the presently described resonator assembly having inactive end segments being effectively decoupled from the remainder of the resonator via decoupling slots operating in conjunction with segmentation slots extending to the nodal plane of the waveguide member.

Having described the feature of decoupled inactive end segments as provided by the present invention, it will be recognized by one of skill in the art that this decoupling feature enables significant flexibility for a mounting arrangement to support the resonator adjacent the photoconductor belt in an electrophotographic machine while also providing increased control of the resonator assembly via the mounting arrangement. Since the inactive end segments are effectively decoupled from the rest of the resonator, the entire geometry of the waveguide member may be utilized as a support for stabilizing the resonator assembly. FIG. 1 illustrates a preferred embodiment for an end cap 112, 113 which is effective for maintaining critical alignment of the waveguide member by counteracting a significant moment force exerted against the contacting tip as a result of belt friction. Each end cap 112, 113 interlocks with the waveguide member at each inactive end segment, entirely surrounding the periphery thereof for providing a rigid and sturdy mounting arrangement to support the resonator assembly in the electrostatographic machine. Alternatively, as shown in FIG. 2, it is contemplated that the present invention could be utilized in combination with a resonator of the type including a vacuum plenum arrangement 101 such that the end cap segments 112, 113 could also be designed to be press fit into a plenum extrusion while interlocking with the end segments of the waveguide member for providing an air tight environment while yielding accurate alignment of the waveguide member member within the plenum without negatively effecting the velocity uniformity and other performance characteristics of the resonator.

With reference again to FIG. 4, it will no doubt be appreciated that the inventive resonator arrangement may find application as a means for improving uniformity of application of vibratory energy to a flexible member for the release of toner therefrom for providing various uses in electrophotographic applications. One example of a use may be in causing release of toner from a toner bearing donor belt, arranged in development position with respect to a latent image. The resonator of the present invention has equal application in the cleaning station of an electrophotographic device with little variation. Accordingly, a resonator assembly in accordance with the present invention may be arranged in close relationship to the cleaning station F, for the mechanical release of toner from the surface prior to cleaning. Additionally, it will be understood by those of skill in the art that improvement in preclean treatment may occur with application of vibratory energy simultaneously with preclean charge leveling.

In review, the present invention generally describes a resonator for use in electrostatographic applications. The resonator is preferably incorporated into a toner transfer system for enhancing transfer of toner from an photoconductive member moving in a process direction, with the resonator positioned generally transverse to the process direction of movement of the photoconductive member, for applying uniform vibratory energy thereto. The resonator comprises a vibratory energy producing element such as a transducer for generating the vibratory energy and a waveguide member member coupled to the vibratory energy producing element for directing the vibratory energy to the adjacent surface, wherein the waveguide member member is divided into segments along a longitudinal axis thereof for forming a plurality of waveguide member segments, each waveguide member segment being separated by a segmentation slot. The waveguide member member of the present invention includes extended inactive end segments situated along opposite ends of the waveguide member and being effectively decoupled from the active transducer for providing a stable mounting point for the resonator, wherein the mounting point can be firmly attached to an external point without effecting the vibrational response of the resonator It is, therefore, evident that there has been provided, in accordance with the present invention, a resonator assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. A resonator assembly for applying uniform vibratory energy to an adjacent surface, comprising:

a vibratory energy producing element for generating vibratory energy, said vibratory energy producing element having a length corresponding to a dimension on the adjacent surface to which vibratory energy is to be applied; and a waveguide member coupled to said vibratory energy producing element for directing the vibratory energy from said vibratory energy producing element to the adjacent surface, said waveguide member member including an active section aligned with the length of said vibratory energy producing element, and inactive end segments situated along opposite ends of said active section and extending beyond the length of said vibratory energy producing element such that the inactive segments are not aligned with said vibratory energy producing element.

2. The resonator assembly of claim 1, wherein said vibratory energy producing element includes a substantially continuous piezoelectric element extending substantially perpendicular to a process width of the adjacent surface.

3. The resonator assembly of claim 1, further including a mounting arrangement for supporting said vibratory energy producing element in contact with the adjacent surface, including;

an end cap for being interlockingly secured to one of the inactive end segments of said waveguide member, wherein said end cap substantially surrounds a periphery of the end segment such that an entire geometry of the waveguide member may be utilized for supporting the vibratory energy producing element.

4. The resonator assembly of claim 1, wherein:

the active section of said waveguide member member is segmented along a longitudinal axis thereof for dividing said waveguide member into a plurality of individual waveguide member segments with each waveguide segment being separated by a segmentation slot.

5. The resonator assembly of claim 4, wherein said vibratory energy producing element includes a plurality of piezoelectric elements corresponding to said plurality of waveguide member segments.

6. The resonator assembly of claim 4, wherein said inactive end segments define a decoupling slot situated between the end segments and the active section of said waveguide member for functionally detaching the end segments from the active section of said waveguide member.

7. The resonator assembly of claim 6, wherein said waveguide member includes a nodal plane defining an area in said waveguide whereat vibratory energy is substantially zero.

8. The resonator assembly of claim 7, wherein said waveguide member includes:

a contacting portion for contacting the adjacent surface; and a platform portion for being positioned in contact with said vibratory energy producing element;

the decoupling slot extending through said platform portion substantially to the nodal plane in substantial alignment with a segmentation slot extending through said contacting portion substantially to said nodal plane.

9. A system for enhancing release of toner from an image bearing member moving in a process direction, including a resonator assembly for applying uniform vibratory energy to the image bearing member, comprising:

a vibratory energy producing element for generating the vibratory energy, said vibratory energy producing element having a length corresponding to a dimension of the photoconductive member to which vibratory energy is to be applied; and a waveguide member coupled to said vibratory energy producing element for directing the vibratory energy from said vibratory energy producing element to the photoconductive member, said waveguide member including an active section aligned with the length of said vibratory energy producing element, and inactive end segments situated along opposite ends of said active section and extending beyond the length of said vibratory energy producing element such that the inactive segments are not aligned with said vibratory energy producing element.

10. The system of claim 9, wherein said vibratory energy producing element includes a substantially continuous piezoelectric element extending substantially perpendicular to a process width of the image bearing member.

11. The system assembly of claim 9, further including a mounting arrangement for supporting said vibratory energy producing element in contact with the photoconductive member, including;

an end cap for being interlockingly secured to one of the inactive end segments of said waveguide member, wherein said end cap substantially surrounds a periphery of the end segment such that an entire geometry of the waveguide member may be utilized for supporting the vibratory energy producing element.

12. The system of claim 9, further including a vacuum apparatus for urging the image bearing member toward said resonator assembly to provide positive contact therebetween.

13. The system of claim 9, further including means for electrostatically attracting the toner from the image bearing member.

14. The system of claim 13, wherein said resonator assembly and said electrostatic attracting means are in substantial alignment with one another.

15. The system of claim 9, wherein:

the active section of said waveguide member is segmented along a longitudinal axis thereof for dividing said waveguide member into a plurality of individual waveguide member segments with each waveguide segment being separated by a segmentation slot.

16. The resonator assembly of claim 15, wherein said vibratory energy producing element includes a plurality of piezoelectric elements corresponding to said plurality of waveguide member segments.

17. The system of claim 15, wherein said inactive end segments define a decoupling slot situated between the end segment and the active section of said waveguide member for functionally detaching the end segments from the active section of said waveguide member.

18. The system of claim 17, wherein said waveguide member includes a nodal plane defining an area in said waveguide member whereat vibratory energy is substantially zero.

19. The system of claim 18, wherein said waveguide member includes:

a contacting portion for contacting the image bearing member; and a platform portion for being positioned in contact with said vibratory energy producing element;

the decoupling slot extending through said platform portion substantially to the nodal plane in substantial alignment with a segmentation slot extending through said contacting portion substantially to said nodal plane.

20. An electrostatographic printing apparatus having a system for enhancing transfer of toner from an image bearing member moving in a process direction including a resonator assembly adapted to contact the image bearing member, generally transverse to the process direction of movement thereof, for applying uniform vibratory energy thereto, comprising:

a transducer element for generating the vibratory energy, said transducer element having a length corresponding to a dimension of the image bearing member to which vibratory energy is to be applied; and a waveguide member coupled to said transducer element for directing the vibratory energy from said transducer element to the image bearing member, said waveguide member including an active section aligned with the length of said transducer element, and inactive end segments situated along opposite ends of said active section and extending beyond the length of said transducer element such that the inactive segments are not aligned with said transducer element.

* * * * *